United States Patent [19]

Kouno et al.

[11] Patent Number: 4,778,201

[45] Date of Patent: Oct. 18, 1988

[54] AUTOMATIC BOOKMARKER BAND

[75] Inventors: Kinuko Kouno, Toyonaka; Shigeru Tamai, Ikeda, both of Japan

[73] Assignee: Corporation Ideo, Osaka, Japan

[21] Appl. No.: 74,191

[22] Filed: Jul. 13, 1987

[30] Foreign Application Priority Data

Jul. 14, 1986 [JP] Japan ..... 61-165208

[51] Int. Cl.[4] ..... B42D 9/00

[52] U.S. Cl. ..... 281/42

[58] Field of Search ..... 281/43, 45

[56] References Cited

U.S. PATENT DOCUMENTS 549,890 11/1895 Austin ..... 281/42 X
565,818 8/1896 Ward ..... 281/42
1,363,120 12/1920 Johnson ..... 281/42
1,914,001 6/1933 Warshay ..... 281/42
2,778,331 1/1957 Bonilla ..... 281/42 X
2,989,023 6/1961 Ellingsen ..... 281/42 X

FOREIGN PATENT DOCUMENTS 3314 of 1904 United Kingdom ..... 281/42

*Primary Examiner*—Paul A. Bell
*Attorney, Agent, or Firm*—Armstrong, Nikaido, Marmelstein & Kubovcik

[57] ABSTRACT

An automatic bookmarker band consisting of an elastic yarn-like band stretched diagonally across a plate-like member and over a corner or edge of any given page of a book. The plate-like member is engageable with the inwardly folded flap of a dust jacket to cover the book.

4 Claims, 3 Drawing Sheets

AUTOMATIC BOOKMARKER BAND

BACKGROUND OF THE INVENTION

1. Field of the Invention

The present invention relates to an automatic bookmarker band and more particularly to a novel yarn-like bookmaker made of an elastic material which can always serve as bookmarker when a book's page is thumbed with the page being read always held by the automatic bookmarker band.

2. Description of the Prior Art

When reading a book in several portions, it is a usual practice to insert a bookmarker at the beginning of the pages not yet read. With the conventional bookmarker, however, it is rather troublesome to remove and reinsert the bookmarker when beginning or finishing reading a given page, and in so doing it is sometimes the case that the bookmarker is dropped or lost. Also, when a reader forgets to insert the bookmarker or the book is closed unintentionally, it is pretty difficult to find the last page read.

SUMMARY OF THE INVENTION

It is an object of the present invention to provide an automatic bookmarker band which can be automatically stretch over the page being read without taking the trouble of removing or reinserting the bookmarker.

Another object of the present invention is to provide an automatic bookmarker band which is not disturbing to the reader and is safe from being lost.

Further objects and advantages of the present invention will be apparent from the detailed description below.

The present invention was completed after intensive study to accomplish the above purpose, and relates to an automatic bookmarker band consisting of a yarn-like band of an elastic material stretched between the retaining means at a proper distance, wherein the above-mentioned retaining means are fixed securely to the dust jacket of a book etc. and the yarn-like band stretched over a corner or edge of a given page of the book.

DETAILED DESCRIPTION OF THE INVENTION

The present invention relates to an automatic bookmarker band in which a yarn-like band of an elastic material is stretched between retaining means provided at a proper distance, and the retaining means are fixedly attached to the cover of a book or the like, and the yarn-like band can stretch over corner or edge of a page.

Referring to the annexed drawings, explained below is an embodiment of the present invention.

Figure 1A:
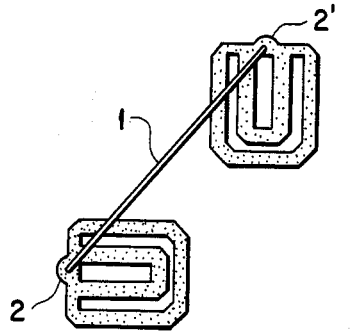
FIG. 1(A) to FIG. 6(A) are perspective views of an embodiment of the present invention, FIG. 1(B), FIG. 2(B), FIG. 3(B) and FIGS. 4(B), (C) are diagrammatic views showing the way the automatic bookmarker band is used and FIGS. 5(B), (C) and FIGS. 6 (B), (C) are further diagrammatic views also showing the way the automatic bookmarker band is used which is respectively shown in views (A) of the respective Figures.

FIG. 1(A) shows an automatic bookmarker band consisting of an elastic yarn-like band (1) of rubber, elastic plastic or elastic textile material and retaining members (clips)(2)(2') with both ends of the former secured to the latter.

The length of the yarn-like band, which depends on the size of the book, may be properly selected within a range of 1–20 cm. The number of the yarn-like bands may be one or more. As clips which are used as retaining means any known kind of clips such as common clip and paper clip suffices.

There is no restriction about material of clips, but metals or plastics are considered suitable.

Figure 1B:
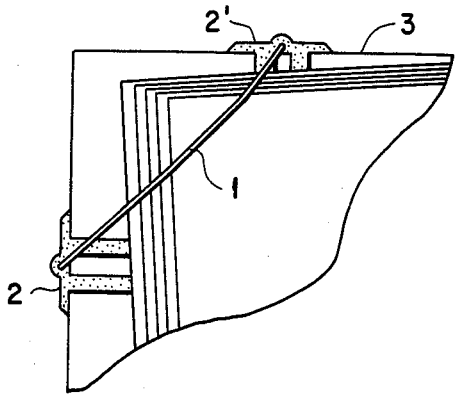

FIG. 1(B) shows the way the automatic bookmarker band of FIG. 1(A) is used, with clips (2)(2') set to the cover (3) of the book itself on the side of the unread pages and the yarn-like band is caused to stretch over the group of unread pages. By so doing, it is possible to thumb the just read page, with unread pages being retained in place by the yarn-like elastic band. Thus the just read page of a book can be thumbed from the first to the last page, hence it can well be called an automatic bookmarker band.

It is also possible to set the clips on the upper and lower edges of the book cover so that the unread pages are held along the vertical edge, but it is considered better to set them near the upper or lower corner as illustrated because of the greater ease with which each page can be thumbed.

Figure 2A:
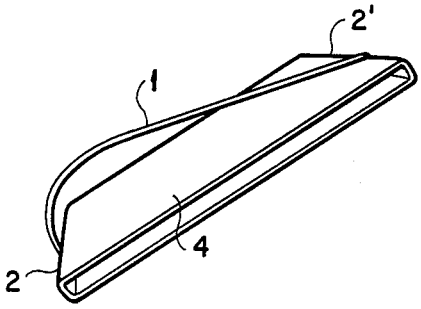
Figure 2B:
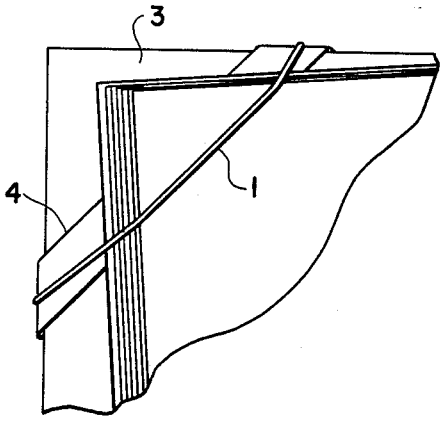

FIG. 2(A) shows another embodiment of the present invention, with band holders (4) are used instead of clips and the yarn-like elastic band attached to retaining means (2), (2'). FIG. 2(B) shows the way the automatic bookmarker band is used, with the corner of the unread pages held on top of the band holder (4).

The above-mentioned band holder (4) may have either front or back surface thereof so trimmed that the part in-between is omitted, or its shape may be made triangular to fit the corner. There is no restriction about the materials of the above-mentioned band holder, but metals or plastics or the like are considered suitable.

Figure 3A:
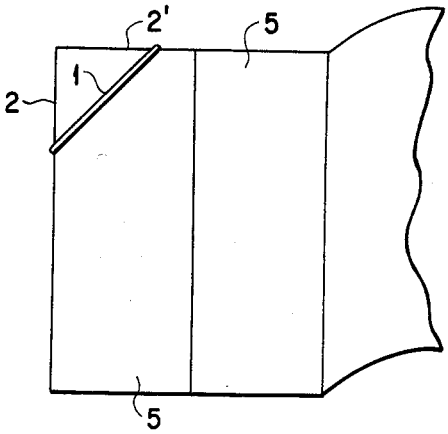
Figure 3B:
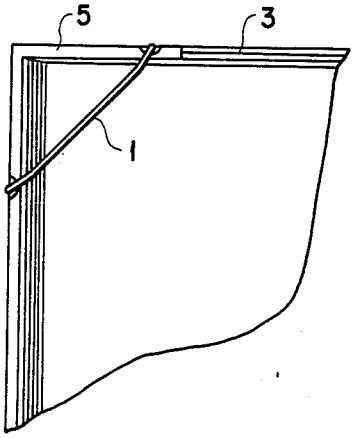

FIG. 3(A) shows still another embodiment of the present invention, in which appropriate points on the sides forming a corner are used as retaining means (2)(2') to which an elastic yarn-like band (1) is provided. FIG. 3 (B) shows a book jacket (5) with an automatic bookmarker with an elastic band of the present invention shown in FIG. (A) attached to the cover (3) of a book with the elastic yarn-like band (1) holding the unread pages of the book.

Figure 4A:
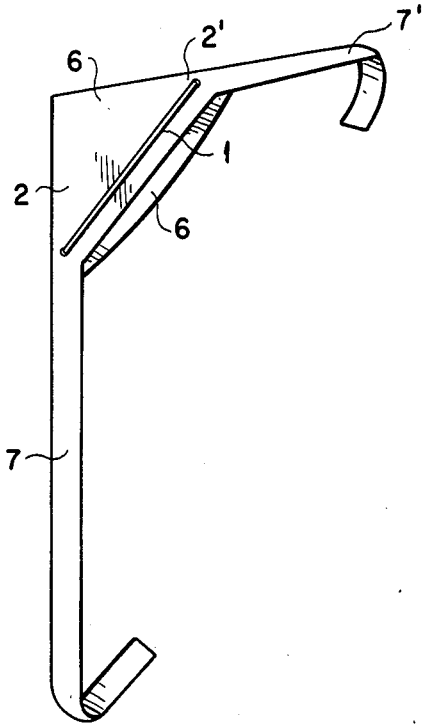

FIG. 4(A) shows further embodiment of the present invention in which an elastic yarn-like band (1) is secured to retaining means (2)(2') at both ends of a bag-like triangular corner (6) made of paper, PVC sheet or the like. As shown in the figure the triangular corner (6) has band-like portions (7)(7') connected thereto or integral therewith.

Figure 4B:
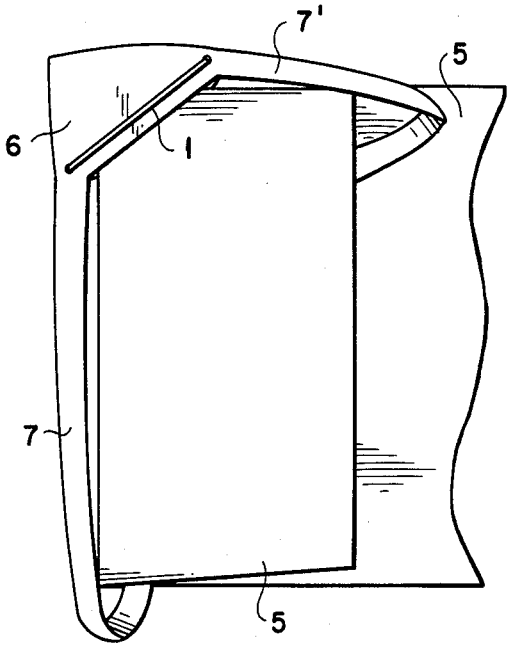
Figure 4C:
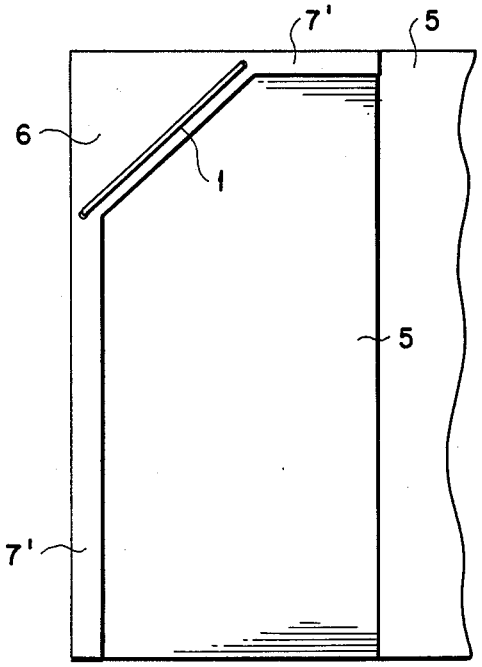

FIG. 4(B) shows the way the automatic bookmarker band of FIG. 4(A) is attached to the book jacket (5), while FIG. 4(C) shows a book cover fitted with the automatic bookmarker band of FIG. 4(A). A corner of the book jacket (5) is inserted in the bag-like triangular corner (6) fitted with the automatic bookmarker band and whose band-like portions (7)(7') are folded into the book jacket to have the bag-like triangular portion secured thereto, the book jacket (5) is set on the cover of the book with the yarn-like band (1) stretching over the unread pages of the book.

Figure 5A:
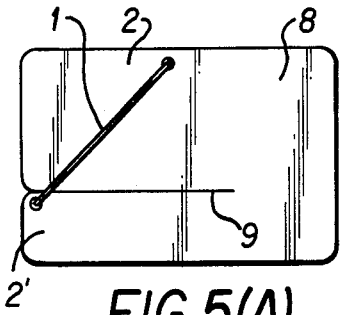
Figure 5B:
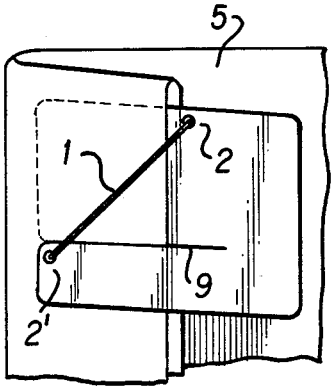
Figure 5C:
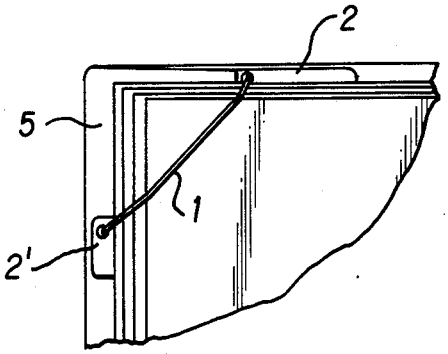

FIG. 5(A) shows a still another embodiment of the present invention, wherein the sides forming an corner of a plate-like member (8) made of paper, plastic or metal are used as retaining means (2)(2') for the elastic yarn-like band (1). The plate-like member has an incision for "clipping" the same onto an inwardly folded flap of the book dust jacket. FIG. 5(B) shows a folding type book jacket (5) provided by a book store or the like fitted with the automatic bookmarker, with the edge of the bag-like portion or inwardly folded flap of the book jacket (5) inserted into the incision (9) made in the plate-like member so that the book jacket (5) is clipped by the plate-like member with the part above the incision (9) inside the flap portion and the part below that outside the same. FIG. 5(C) shows the cover of a book fitted with the book jacket (5) and the yarn-like band (1) stretching over the corner of the unread pages.

Figure 6A:
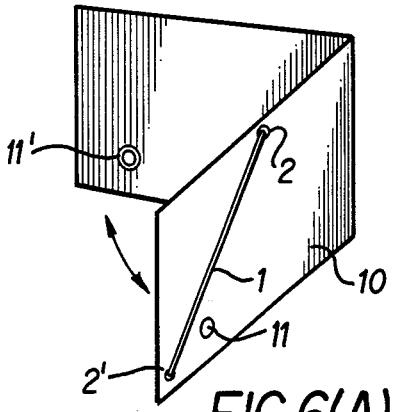
Figure 6B:
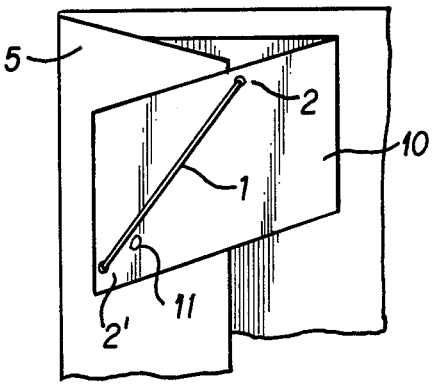
Figure 6C:
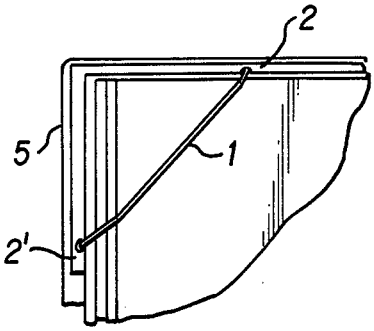

FIG. 6(A) shows still another embodiment, wherein a plate-like member (10) made of paper, plastic, metal or the like with a crease approximately along the center line to be foldable in two is provided. On the two sides forming a corner of the outside half of the plate there is provided on each retaining means (2)(2') for the yarn-like band (1). In the plate-like member folded in two the recessed and projected parts (11)(11') of a snap hook are provided at the corresponding points. FIG. 6(B) shows a simply folded-type book dust jacket (5) provided by a book store fitted with the automatic bookmarker band of FIG. 6(A), wherein the plate-like member (10) of the automatic bookmarker band can be secured to the inwardly folded flap of the book jacket (5) by folding in two, setting it onto the flap of the book jacket (5) and then engaging the snap hook, (11)(11'). Instead of the snap hook a double tack tape, adhesive or the like may also be used. FIG. 6(C) shows the book jacket (5) of FIG. 6(B) set on the cover of a book with the yarn-like band (1) stretching over a corner of the unread pages.

In the above, FIG. 1 shows an example in which the retaining members are separated, FIG. 2 another example in which an integrated retaining means is used, FIG. 3 still another example in which the book cover is used as a retaining means and FIGS. 4–6 examples in which the book jacket is fitted with an automatic bookmarker band, but, needless to say, the present invention is not limited thereby.

To further improve the fixing capability of the retaining means, it is preferable to make the inside thereof irregular or have it lined with rubber or elastomer of high friction coefficiency.

In the present invention, the word "book" also includes notebooks, pocketbooks, memorandum-books and the like.

As mentioned above, adoption of the automatic bookmarker band of the present invention, has great advantages of:

(1) Anytime when the book being read is closed, the band is over the page being read automatically and it is no longer necessary to insert a bookmarker or the like each time.

(2) If the book being read is closed unintentionally, the unread pages are held by the band at a corner, hence the page wanted can be found readily.

(3) Secured to the jacket of a book or book cover, it is not disturbing the reader, and there is no risk of being lost, being thus epoch-making.

What is claimed is:

1. An automatic bookmarker for use in combination with a book having pages, a book cover, and a dust jacket over the cover, the dust jacket having an inwardly folded flap positioned between the pages and the cover, said bookmarker comprising a plate-like member having means for securely engaging the inwardly folded flap of the dust jacket, and a yarn-like band of elastic material fastened at each of its ends to said plate-like member and extending diagonally with respect to an upper edge of said plate-like member which extends in parallel to an upper edge of the dust jacket whereby when the plate-like member is engaged with the flap of the dust jacket between the cover and the pages of the book, the yarn-like band can be stretched over a corner of any given page of the book.

2. The automatic bookmarker in accordance with claim 1, wherein said means for securely engaging the inwardly folded flap consists of an incision made in the plate-like member extending parallel to said upper edge of said member from one side edge of said member, said yarn-like band crossing said incision, the inwardly folded flap when inserted into said incision being clipped by said plate-like member with part of the member above the incision being inside the flap and part below the incision being between the flap and the pages of the book.

3. The automatic bookmarker in accordance with claim 1, wherein said plate-like member is foldable along a crease which is perpendicular to said upper edge and divides said plate-like member into an outside half and an inside half, said yarn-like band being provided on an outer face of said outside half, and wherein said means for securely engaging the inwardly folded flap of the dust jacket is provided on both the outside half and the inside half for holding the flap of the dust jacket therebetween.

4. The automatic bookmarker in accordance with claim 3, where said means for securely engaging comprises a snap hook having a recessed part and a projected part, one of which is provided on said inside half and the other is provided on the outside half of the plate-like member.

* * * * *